United States Patent [19]

Poloni et al.

[11] Patent Number: 4,714,355

[45] Date of Patent: Dec. 22, 1987

[54] COMPENSATING DEVICE FOR ROLLING STANDS WITH ROLLS SUPPORTED AT ONLY ONE END

[75] Inventors: Alfredo Poloni, Ronchi Dei Legionari; Fausto Drigani, Zugliano Di Pozzuolo Del Friuli; Roberto Canzutti, Percoto, all of Italy

[73] Assignee: Danieli & C. Officine Meccanichi SpA, Buttrio, Italy

[21] Appl. No.: 838,792

[22] Filed: Mar. 12, 1986

[30] Foreign Application Priority Data

Mar. 12, 1985 [IT] Italy ..... 83344 A/85

[51] Int. Cl.[4] ..... F16C 17/02

[52] U.S. Cl. ..... 384/193; 384/202; 384/215; 384/258

[58] Field of Search ..... 384/193, 199, 200, 215, 384/218, 517, 518, 249, 258, 202

[56] References Cited

U.S. PATENT DOCUMENTS

| | | | |
|---|---|---|---|
| 2,026,349 | 12/1935 | Lafferty | 384/149 |
| 3,001,839 | 9/1961 | Horberg | 384/518 |
| 3,804,562 | 4/1974 | Hansson | 384/517 |
| 4,529,324 | 7/1985 | Champagne et al. | 384/518 |

FOREIGN PATENT DOCUMENTS 1456709 10/1966 France .

*Primary Examiner*—Lenard A. Footland

*Attorney, Agent, or Firm*—Wegner & Bretschneider

[57] ABSTRACT

Compensating device able to compensate the load acting on e upper bearings (13–17) of shafts of rolls (10) supported at only one end on rolling stands (18), such rolls (10) comprising shafts (11) having at least two bearings (13–14), an upper bearing (13) and a lower bearing (14), the device comprising springs (20) able to provide a resiliently yielding constraint between such bearings (13–14).

6 Claims, 8 Drawing Figures

COMPENSATING DEVICE FOR ROLLING STANDS WITH ROLLS SUPPORTED AT ONLY ONE END

This invention concerns a compensating device for rolling stands with rolls supported at only one end. To be more exact, the invention concerns a device to compensate the load applied to the bearing brasses at the upper end of rolling rolls supported at only one end on rolling stands.

As is known, the rolling rolls supported at only one end on rolling stands are upheld by eccentric bearings which serve to adjust the distance between centers of such rolls.

Such bearings are slightly rounded on their outer surface cooperating with the housing of the stand.

In known embodiments the upper eccentric bearing and the lower eccentric bearing of each rolling roll shaft constitute one whole together or are united by a rigid half-sleeve element. This entails less possibility of deformation of the upper bearing or rather less possibility of movement of the bearing in relation to the housing of the stand when rolling force is applied to the rolling roll.

As a result, the specific pressure on the upper portion of the bearing brass of the upper bearing is very great on the side on which the rolling takes place, and therefore the bearing brass tends to size or in any event to become worn or damaged.

To obviate this drawback the invention provides for modification of the constraint between the upper and lower eccentric bearings, the fixture being effected by means of pre-loaded springs. Such springs permit the rotation of the upper bearing to follow the deformation of the shafts of the rolling rolls.

The excessive specific pressure taking place in the known embodiments on the upper portion of the bearing brass is compensated in this way. Moreover, the development of such specific pressure can be conditioned by acting on the preloading of such springs.

In a preferred embodiment of the invention such springs are positioned below the head of a screw that connects the upper eccentric bearing to a rigid half-sleeve element that unites the upper bearing to the lower bearing.

To be more exact, a series of holes to lodge such connection screws is provided on the circumference of the upper eccentric bearing. The screws cooperate with springs, preferably cup springs or Belleville springs, lodged in the upper portion of such holes.

It is possible in this way to obtain, by suitable adjustment of the pre-loading of the springs, compensation of the excessive forces acting on the bearing brass.

Owing to the type of attachment provided, the rotation of the upper eccentric bearing under load is greater than it would be in the event of a rigid fixture. The upper bearing, therefore, adapts itself to the deformation of the shaft of the roll, as said earlier, to a greater extent than occurs in the known art.

In an alternative embodiment it is possible to position the springs in the lower side of the eccentric bearing.

In the case too the springs can be pre-loaded in such a way as to obtain the required compensation, thus reducing the maximum pressure acting on the bearing brass under load and therefore obviating occurrences of seizing or eccessive wear.

The invention is therefore embodied with a compensating device able to compensate the load acting on upper bearings of shafts of rolls supported at only one end on rolling stands, such rolls comprising shafts having at least two bearings, an upper bearing and a lower bearing, the device being characterized in that it comprises springs able to provide a resiliently yielding constraint between such bearings.

We shall now describe some embodiments of the invention as a non-restrictive example with the help of the attached figures.

Figure 1:
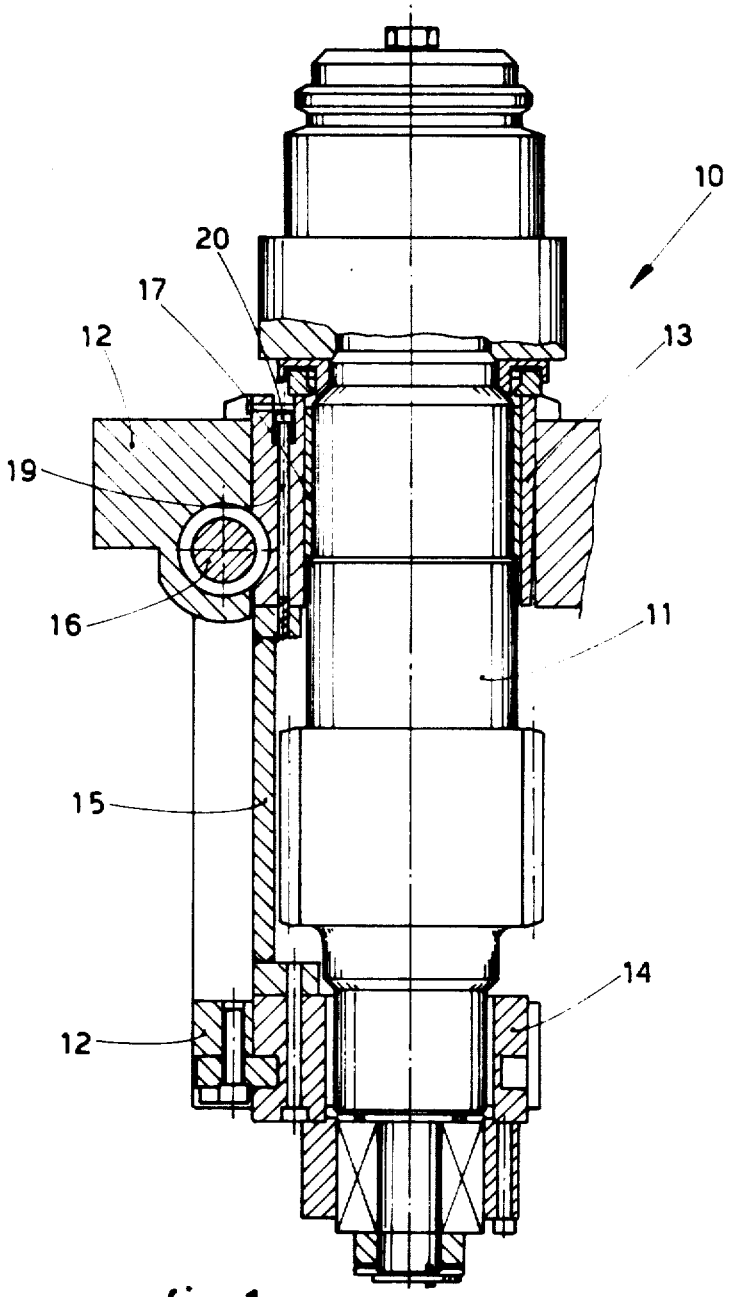
FIG. 1 shows a preferred embodiment of the invention applied to a roll of a rolling stand.
Figure 3A:
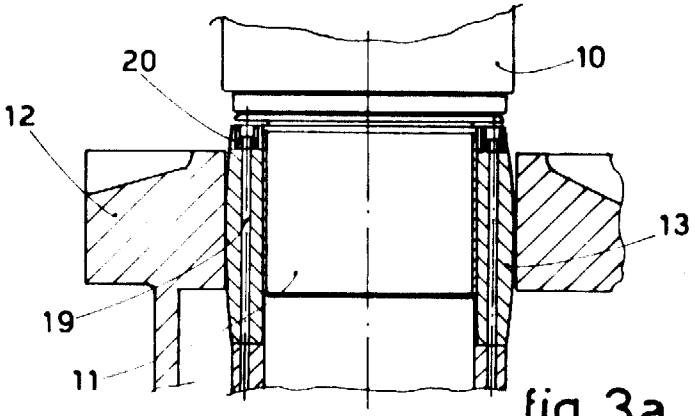
Figure 3B:
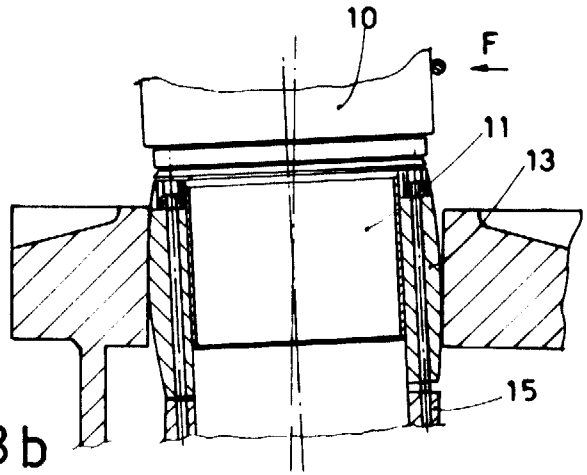
Figure 4A:
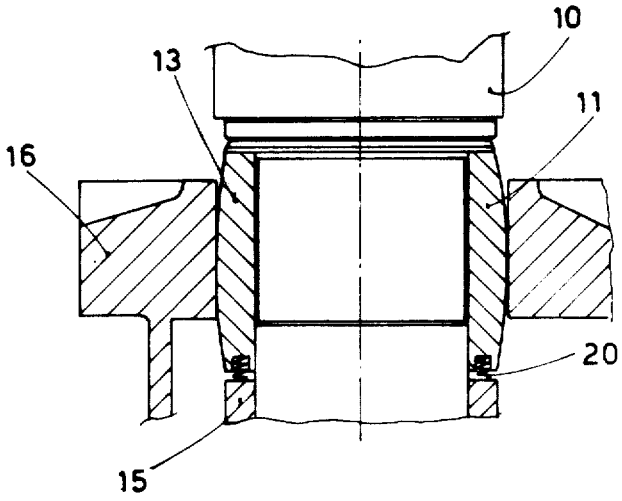
Figure 4B:
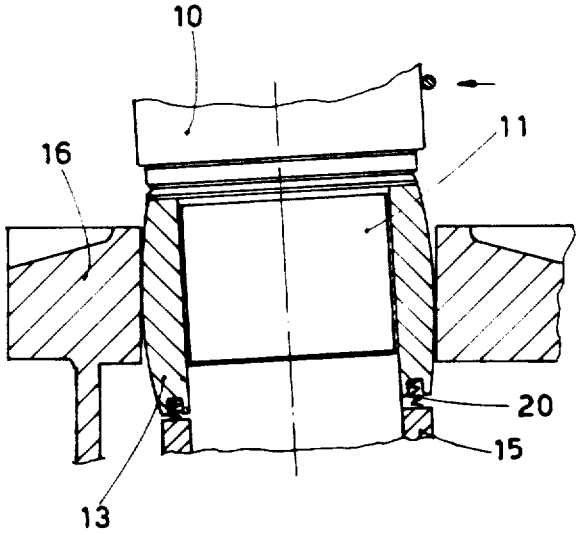
Figure 6:
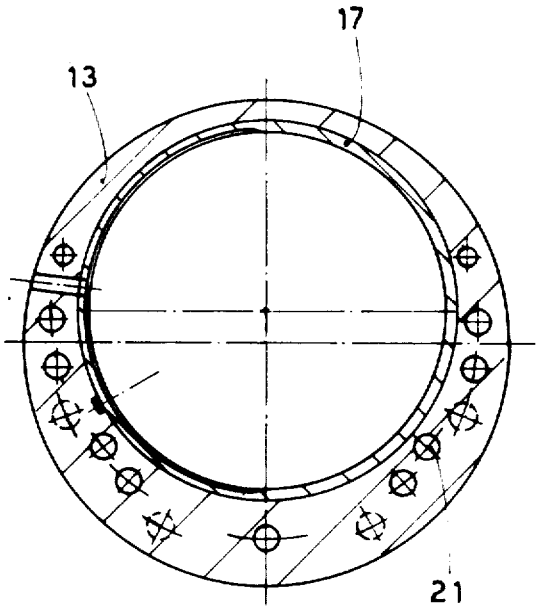
Figure 5:
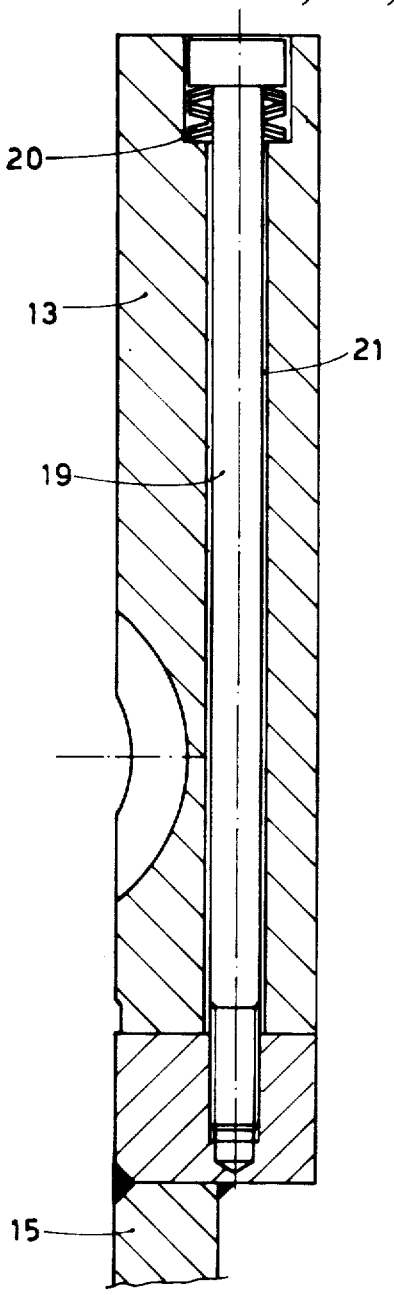

FIGS. 3*a* and 3*b* show the behavior of the embodiment of FIG. 1, both without load and under load;

FIGS. 4*a* and 4*b* show a variant with springs introduced into the bearing from below;

FIG. 5 gives a detail of FIG. 1;

FIG. 6 gives a plan view of a section of the bearing of FIG. 1.

In FIG. 1 a rolling roll 10 comprises a shaft 11 supported in this example by a housing 12 of a rolling stand by means of an upper bearing 13 and lower bearing 14, such bearings 13–14 being united by a substantially rigid half-sleeve element 15.

This embodiment has been employed in this case to enable motion to be taken by a toothed wheel 22 solidly fixed to the shaft, but in other known embodiments it is possible to arrange for the toothed wheel 22 to be supported at one end below the lower bearing 14, with the two bearings 14-13 forming one single whole, preferably with two separate bearing brasses, upper and lower, supporting the shaft 11.

An adjustment screw 16 can be seen and cooperates with the upper bearing 13 and serves to rotate the bearings 13–14 so as to adjust axially the distance between the rolls 10.

Figure 2:
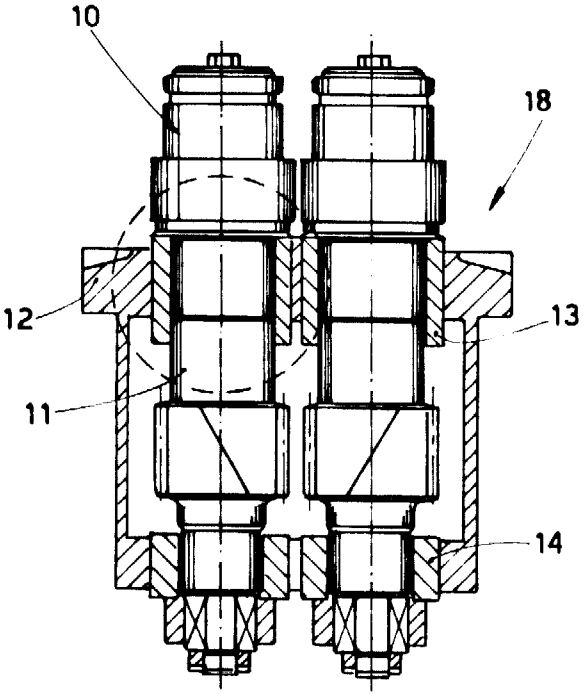
FIG. 2 shows a rolling stand with rolls supported at only one end so as to provide a better general picture of the invention.

FIG. 2 gives a diagrammatic view of a stand 18 which bears the rolls 10 and to which the invention is applied. This view shows both the rolling rolls 10 with the respective bearings 13–14 and a housing 12 of the stand.

The area to which the invention is applied is surrounded by a circle of dashes, FIG. 2 being provided merely to give a general picture of the area of application of the invention.

With reference again to FIG. 1, it is possible to see how the upper bearing 13, which is slightly rounded on its outer surface, is connected to the rigid half-sleeve element 15 by a connection which is partially resilient.

In fact, the upper bearing 13 is connected to the rigid half-sleeve element 15 by connecting screws 19, under the heads of which are lodged cup springs or Belleville springs 20.

This embodment is shown in detail in FIG. 5, in which the upper bearing 13 can be seen to be united to the rigid half-sleeve element 15 by means of the above connecting screw 19; FIG. 5 shows also the springs 20, cup springs or Belleville springs in this example, which form the resilient compensating element according to the invention.

FIG. 6 gives a view of a section of the upper bearing 13. Through holes 21 for passage of the various screws 19 and also a bearing brass 17 positioned in the upper bearing are evident.

FIGS. 3*a* and 3*b* illustrate the behavior of the embodiment of FIG. 1 when under load. FIG. 3*a* gives a diagram of the embodiment of FIG. 1 in which the outer curvature or swelling of the upper bearing 13 has been exaggerated. It is possible to see that under normal conditions the upper bearing 13 thus shown in this diagram is rested at its lower end on the top of the rigid half-sleeve element 15 and is constrained against the same by the screws 19 and cup or Belleville springs 20.

The cup or Belleville springs 20 can be suitably preloaded either with an equal pre-loading of all of them or with a pre-loading varying between the individual springs or groups of springs.

It is possible in this way to obtain an arrangement with a differentiated degree of yielding, depending on the various positions which can be taken up by the upper bearing owing to the adjustment of the distance between the rolls.

It is also possible to compensate varying values of the stress on the bearing brass as a result of variations in the rolling force.

FIG. 3*b* shows, for indicational purposes only, how the upper eccentric bearing 13 adapts itself according to the invention to deformation of the shaft 11 of the rolling roll. In fact, it is possible to see that under the rolling force "F" the shaft 11 takes up a deformation to which the upper bearing adapts itself, the bearing being constrained in a non-rigid manner to the half-sleeve element 15 by the springs 20.

The pressure of the springs is therefore unloaded on the rolling side to the right of FIG. 3*b*, such unloading being shown in the figure by an ascent of the whole bearing, which can rotate counterclockwise the deformations, of course, are exaggerated in the figure.

FIGS. 4*a* and 4*b* show instead another variant in which the upper bearing 13 is connected resiliently to the half-sleeve element 15, the springs being positioned between the bearing and the half-sleeve element.

Under the rolling force "F" (FIG. 4*b*) the springs on the left in the figure are loaded, whereas those on the right are unloaded. In this case too the deformations have been heavily exaggerated.

The upper bearing 13 will be prevented from rotating, for instance, by screw studs cooperating with holes in the half-sleeve element 15, or by pins or teeth or other known means.

In this case too the pre-loading of the springs 20 can be adjusted in a known manner so as to provide the compensation conditions most suitable for the type of bearing brass and for the load applied.

We have described here some preferred embodiments of the invention, but variants are possible without departing thereby from the scope of the invention. For instance, resilient means 20 of any required type can be employed; it is possible to vary the number and positioning of the springs and the nature of the pre-loading and of the means which carry out such preloading. These and other variants are all possible without departing thereby from the scope of the invention.

We claim:

1. A roll for a rolling stand supported at only one end, comprising:

a shaft;

an upper and a lower bearing carrying the shaft;

a connection means between said upper bearing, which is slightly rounded longitudinally, and said lower bearing fixing said bearings to each other; and means providing a plurality of springs which allow said connection means to provide a resiliently yielding constraint between said upper bearing and said lower bearing to allow the upper bearing to follow deformation of the shaft; wherein said springs cooperate with screws to resiliently yieldingly secure said upper bearing to said lower bearing through said connecting means; wherein said springs are preloaded springs; wherein said springs are cup or Belleville springs; wherein said springs are lodged in the upper or lower portion of at least one of the bearings; and wherein said springs are located circumferentially.

2. A roll as claimed in claim 1, wherein said springs are equally preloaded.

3. A roll as claimed in claim 1, wherein said springs are preloaded differentially.

4. A compensating device for incorporation into a roll of a rolling stand supported at only one end, said roll comprising a shaft having an upper bearing, which is slightly rounded longitudinally, and a lower bearing carrying the shaft, and a connection means between said upper bearing and said lower bearing fixing said bearings to each other, said compensating device comprising means including a plurality of springs which allow said connection means to provide a resiliently yielding constraint between said upper bearing and said lower bearing to allow the upper bearing to follow deformation of the shaft; wherein said springs cooperate with screws to resiliently yieldingly secure said upper bearing to said lower bearing through said connecting means; wherein said springs are pre-loaded springs; wherein said springs are cup or Belleville springs; wherein said springs are lodged in the upper or lower portion of at least one of the bearings; and wherein said springs are located circumferentially.

5. A compensating device as claimed in claim 4, wherein said springs are equally pre-loaded.

6. A compensating device as claimed in claim 4, wherein said springs are pre-loaded differentially.

* * * * *

UNITED STATES PATENT AND TRADEMARK OFFICE

CERTIFICATE OF CORRECTION

PATENT NO. : 4,714,355

DATED : December 22, 1987

INVENTOR(S) : Alfredo Poloni et al

It is certified that error appears in the above-identified patent and that said Letters Patent is hereby corrected as shown below:

On the title page assignee should read

-- Danieli & C. Officine Meccaniche SpA--.

Signed and Sealed this

Twenty-first Day of June, 1988

*Attest:*

*Attesting Officer*

DONALD J. QUIGG

*Commissioner of Patents and Trademarks*